US008944942B2

(12) United States Patent
Oravecz

(10) Patent No.: US 8,944,942 B2
(45) Date of Patent: Feb. 3, 2015

(54) APPARATUS SUSPENSION SYSTEM

(71) Applicant: Paul Oravecz, Los Angeles, CA (US)

(72) Inventor: Paul Oravecz, Los Angeles, CA (US)

( * ) Notice: Subject to any disclaimer, the term of this patent is extended or adjusted under 35 U.S.C. 154(b) by 0 days.

(21) Appl. No.: 13/716,144

(22) Filed: Dec. 15, 2012

(65) Prior Publication Data

US 2014/0171236 A1 Jun. 19, 2014

(51) Int. Cl.
*A63B 69/36* (2006.01)
*A63B 59/00* (2006.01)

(52) U.S. Cl.
CPC ..... *A63B 59/0014* (2013.01)
USPC ..... 473/518

(58) Field of Classification Search
USPC ..... 473/201–206, 219, 226, 251, 409, 458, 473/518; 2/16, 161.1, 161.2, 161.8, 163
See application file for complete search history.

(56) References Cited

U.S. PATENT DOCUMENTS

| | | | | |
|---|---|---|---|---|
| 1,306,442 | A * | 6/1919 | Sansotta | 2/21 |
| 2,709,257 | A * | 5/1955 | McKinney | 2/16 |
| 3,103,213 | A * | 9/1963 | Robinson | 124/88 |
| 3,612,521 | A * | 10/1971 | Wendeborn | 482/48 |
| 5,062,625 | A * | 11/1991 | Vonk | 482/48 |
| 8,043,171 | B2 * | 10/2011 | Huffman et al. | 473/409 |
| 2008/0276341 | A1 * | 11/2008 | Duby | 2/16 |

* cited by examiner

*Primary Examiner* — Nini Legesse
(74) *Attorney, Agent, or Firm* — Benman, Brown & Williams

(57) ABSTRACT

A suspension system for eliminating the need to tightly grasp, grip or clench any apparatus (i.e. sports racket, hammer, device, instrument, tennis racquet, squash racquet, racquetball racquet, badminton racquet, lacrosse stick, etc), by producing an apparatus suspension system and decreasing or eliminating the amount of grip pressure required from the hand, wrist and the arm or any part of the body. The suspension system generally includes flexible suspension connector (s), stabilizers, connector-like devices, adjustable finger devices and an adjustable thumb device and/or a glove that, altogether, become a suspension system.

10 Claims, 9 Drawing Sheets

APPARATUS SUSPENSION SYSTEM

CROSS-REFERENCE TO RELATED APPLICATION

This patent application claims the benefit of U.S. Provisional Patent Application Ser. No. 61/630,828 entitled, "Grip Suspension System," filed on Dec. 20, 2011, which application is incorporated in its entirety here by this reference.

BACKGROUND OF THE INVENTION

The embodiment relates generally to apparatus suspension systems and one embodiment more specifically relates to an apparatus suspension system for eliminating the need to tightly grasp, grip or clench any apparatus (i.e. sports racket, hammer, device, instrument, tennis racquet, squash racquet, racquetball racquet, badminton racquet, lacrosse stick, etc), by producing an apparatus suspension mechanism eliminating the need of a grip required from the hand, wrist and the arm.

In racket sports for instance, up until now, it has been required that the user tightly grip the apparatus. With this embodiment, the user has an added competitive edge, thrill and mental competitive advantage to game play by not having to clasp the apparatus and instead, the device clasps the apparatus for them and thus does the hard work for them.

This embodiment is classified in a field of prior art, where the focus has been gripping the apparatus to try to make it easier to learn to use the device properly, to carry out play or its intended use and to possibly win more games or more successfully use the implement.

The difference in this embodiment, i.e., not gripping the apparatus, carries great weight. First, this embodiment is contrary to the teachings and scope of the prior art, where gripping is the key. This is because the advantage of letting go of an apparatus, like a racket in tennis for example, while hitting say a ball, has not been possible or implemented in the history of gameplay like in tennis, racket ball or similar activities. This embodiment solves many long felt, long-existing and unsolved needs and thereby provides unprecedented advantages to the user.

This embodiment successfully solves a problem that has been heretofore unsolvable which would be to have control of an apparatus without gripping it and still increase game play or the use of the device for its intended purposes. This embodiment omits elements in the prior art, for instance inventions that involve gripping paraphernalia, gloves and finger-type devices, whose focus was on helping the user grip the apparatus. This embodiment is opposite in that its focus is on not having the user grip the apparatus, but rather on having the user let go of the apparatus while greatly increasing the capability of the user.

What has not been achieved in the prior art is the feeling, knowledge or fact that the user does not have to hold on to the apparatus. The reason this is important is that it allows the user to experience new sensations and mental perspectives about participating in the activity or sport and experience the feeling of freedom that the user experiences when they understand that they do not have to do the work to hold the apparatus, driving unprecedented mental advantage, enthusiasm, excitement, and creativity in the intended activity or as in tennis, game play. Thus it makes the user feel differently about the game, i.e., have a more positive attitude toward the situation, which is key to optimizing the use or the implement and winning.

This embodiment solves a problem that has never been recognized before which is gripping the apparatus in any form produces a more unnatural situation and sensation that actually results in poorer use of the device or in tennis, game play. This may seem counter intuitive in that many inventions have focused on the user "gripping" the apparatus. However, the act of gripping is what causes the user problem, limiting their use of the apparatus as well as the quality of the experience when using the apparatus. Other inventions focused on trying to solve the problem of "gripping" by modifying the way the user "grips" the device. Other inventions did not try to resolve the ability to "not" grip the device, whereas this embodiment specifically uncovers and solves the notion that not gripping the device actually results in better use and results in better outcomes when using the apparatus.

When a user utilizes an apparatus, they would normally be required to grip the apparatus with their hand. This embodiment allows the user to use the apparatus without gripping it.

In particular, but not limited to the field of rackets used for sports, for instance tennis, racquetball, squash and the like, the apparatus or the handle is shaped as cylindrical, oval, rectangular or octagonal member and requires the user to grip the handle. Other prior art finds fault with the racket handle in that it does not provide enough tactile indication for the orientation of the face of the racket. A small error in the angle of the racket can produce a large error in the trajectory of the ball when struck by the racket. In addition, other prior art finds fault with how the user grips the apparatus or handle in that it becomes slippery, due to perspiration, requiring the user to grip the apparatus or handle even more tightly during play and this in turn can lead to fatigue of the hand, arm, shoulder and the player as well as such things like blisters and the like and possible permanent damage to the body.

This embodiment does not find fault with the racket's ability to provide tactile indication or to solve slipperiness of the racket handle due to perspiration because the user does not grip the handle but rather the flexible suspension system secures the racket handle in place and fingers loosely act as guides. The issue of perspiration and a slippery racket is solved in this embodiment, because there is plenty of air surrounding the hand and the apparatus or racket handle.

This embodiment also solves the issue of tactile indication in several ways. In normal play, a racket has a limited, small area on the racket face called the sweet spot. It is the intention of players to hit the sweet spot on a regular basis because this is where the optimal power and control of the racket emanates from. However, this is difficult for even the most advanced player to do consistently.

Every aspect of the game is influenced by what the user is thinking, feeling or focusing on and their ability for mental concentration. Control of the mind and emotions is critical. One issue, in tennis, is the user's awareness of the center of the racket or sweet spot. The issue for most players is that they are not easily and/or repeatedly aware of the sweet spot and therefore they are not regularly hitting the ball optimally. In fact, most players rarely hit the "sweet spot." Not only is hitting the sweet spot necessary for better game play, but it provides the player with an exaggerated feeling of physical and mental well-being or euphoria/rapture.

Other prior art fails to advance the art and address the issue of consistently hitting the sweet spot of the racket by not gripping the racket handle. This embodiment makes it easier for the user to find and hit the sweet spot on a continual basis. Often users are told to "relax" so that they can play in the "zone" or in the ideal mental performance state. Conventional advice to players consists of telling them to shut off their minds or tire themselves out so as to tap into the subconscious mind to play in the "zone." Tapping into the subconscious mind is difficult when the mind is focused on gripping and managing an unnatural device in one's hand, such as a racket and readying themselves to hit the ball as hard as they can, resulting in a paradox. The placement of a racket handle within the hand normally requires that the user grip it, but by doing so the user becomes less aligned with their body and more aligned with holding onto the racket handle. This shift in focus and physicality means that the user is now in an unnatural state.

With this embodiment, the user is in a more natural state and remains aligned with their body. The racket is secured to the hand by the suspension system and results in a sensation where the racket feels like a natural extension of their hand and arm. This more natural feeling provides the user with a greater degree of comfort and a new dimension of mental freedom. This mental freedom allows the user to experience a superior ability to concentrate on things other than holding the racket, thereby increasing their game play capabilities. In this embodiment, the user experiences a liberating sensation that heretofore has not been possible because they were focusing on and gripping the racket handle; instead with this embodiment the user increases their awareness, perception, consciousness and responsiveness to both optimally hitting the ball towards their opponent as well as optimally responding to the ball hit by the opponent towards the user and utilizing the sweetspot more consistently.

When a user employs this embodiment, they are in a constant state of relaxation, where they are able tap into the subconscious mind and hit in the "zone." As a result of this advanced state of mind, their reactions and accuracy improve allowing them to consistently hit the "sweet spot." Instead of the user having an occasional and haphazard strike on the "sweet spot" they are now able to consistently make this a repeatable action because the user hits the sweet spot more often, the user is able to get into the groove, training the mind and this mental memory is engrained to this new pattern, thus advancing their game play as well as their confidence, concentration and desire to continue to play.

Another aspect of this embodiment is its affect on the affective size of the sweet spot. The softest part of the racket face, the sweet spot, is the center. When the racket handle is held rigidly, the sweet spot is in its smallest diameter. When the racket handle is suspended with a flexible-member suspension system and the player miss hits the ball, missing the sweetspot, with this embodiment the shock is not transferred to the player because the suspension system absorbs the shock and thereby effectively increases the affective area of the sweet spot of the racket. In this embodiment, because the user is not gripping the racket handle, the effective sweet spot area is essentially increased, increasing the optimal power and control of the racket and advances the user's game play and euphoric feeling which advances their game mind and mental state of mind.

When a user grips the racket handle, and misses the sweet spot it sends a shocking reverb to the user's hand. If the user does not have to grip the apparatus and misses the sweet spot, as in this embodiment, the user experiences less of a shocking reverb, reducing the exhaustion of the arm, hand, shoulder and body and reducing the feeling of physical and mental defeat or discouragement. Because the player hits the sweet spot more often, they have more control over the gameplay and the user will want to play more often, resulting in better overall health, fitness, positive mental state of mind and wellness and could reduce the level of obesity in the world, where obesity related medical costs at the time of this writing in the US alone are ~$160 Billion/year and diseases like diabetes, at a cost to the US at $174 Billion/year.

Another aspect of this embodiment is the affect it has on the mindset of the player. Often times when someone is looking to pick up the sport, they find it difficult to advance their play. This embodiment increases the confidence, enthusiasm, pleasure and desire of the user to continue to play and thus provides the necessary encouragement for those who would have ordinarily given up because they could not consistently hit the sweet spot, making the embodiment a more commercially viable and tennis and the like a more wide spread activity.

Another aspect of this embodiment is the affect on the user's charka system. When the user hits the sweet spot on a regular basis, that action transfers energy to the body and the interaction serves to align the body's chakras or energy centers, so as to result in better mental centeredness and alignment. Tennis can then become a method for all levels of players to experience enhanced mental balance and alignment. The repeated action of Charka alignment provides the user with a strong sense of well-being such that they will want to play more often, resulting in enhanced physical health. In addition, because players will want to play more often, this increased volume of players and playing will drive economics by the way of the need for the production of more tennis rackets, balls, tennis shoes, and the like, making this embodiment a economically feasible product and this has the effective of enhancing the economic climate of all countries who deploy this embodiment.

A racket handle is designed with a specific shape for a specific purpose. For instance, octagonal member of a tennis handle is designed to optimally fit in the palm of the user. The top, the bottom, and the 3-sided flatten areas of the racket handles are designed so that there are no sharp edges and so it coincides with an efficient and comfortable feel. The larger, flatten sides of the racket handle provides the user knowledge of where the face of the racket is pointed. The bell part of the racket provides resistance against the lower palm so as not to leave the user's hand.

While other prior art seeks to change the shape of the racket handle, our embodiment allows the user to optimize use of the racket with the original design of the racket handle, where the racket handle design has been optimized in certain ways for specific reasons, without changing it. This embodiment therefore takes advantage of the handle or apparatus's specific, preferred and perfect shape. The problem is not with the design of the apparatus or handle, but rather that the prior art has not figured out how best to provide a system for the user to hold onto and swing the racket without having to grip it so as to not loose hold of the racket in the swinging process and/or control the racket to complete the intended gameplay correctly. The other prior art tries to change that "perfect" shape of the handle or apparatus because their focus is on tighter or more effective apparatus or handle "gripping" by the user. In this embodiment, the apparatus does the gripping for the user.

In this embodiment, the user's palm and the index finger, the middle finger, the connector finger and the pinky finger and the thumb or any combination of fingers can be used by the suspension system and provides a closed, yet flexible connector or net that secures the apparatus and as such, allows for the optimal use that apparatus or handle as it was designed and intended for.

Attempts have been made in the prior art to modify the handle of the racket to overcome the problems of excessive perspiration or grip effectiveness. Those modifications include, but are not limited to finger grooves which are in the form of a handle or an apparatus member that receives the fingers and/or thumbs of the user. Although the finger/thumb grooves may increase frictional engagement with the hand of the player, they do not necessarily increase the tactical perception of the angle of the face of the racket. The finger receiving grooves require custom creation based on the different sized hands and finger/thumb spacing of each individual. The multiplicity of size and configuration prevents the practical and/or profitable distribution of these forms of the racket and or the apparatus.

This embodiment does not require that the user modify the racket handle, i.e., to take the racket apart, drill holes in the racket, attach grips or finger groves or the like, but instead takes advantage of the perfect design of the racket handle "as is" and uses it to its highest degree by being a ready-to-use product without any modification to this embodiment or the racket or its handle.

In addition, the finger groove apparatuses in the prior art must be able to receive both the right and left hand, as it is impossible for the fingers of the left hand to fit into the grooves for the right hand and vice versa. Thus the users would have to stop play in the middle of game play and take off the finger groove and place the correct one for, say the right hand when using for right-handed swing, and then need to stop game play and put on a left-handed finger groove when using a left-handed swing. This makes that prior art impossible to use during ordinary play and commercially unviable.

In some sports like tennis, users may change their grip on the racket for backhand and forehand strokes. Many of the grooved handles in the prior art are adapted to accommodate such a shift in the grip of the player. However, in normal use, players change their grip on the racket more markedly from a western grip to a continental grip to effect top spin, under spin or the like within seconds, making the prior art unpractical as it would take longer to adjust the grip position than allowed in normal game play. A grooved apparatus or handle construction may actually impede the user's ability to quickly shift playing style and technique. And as the market shows, much of the prior art has not been widely adopted by the tennis community as evidenced by the lack of these products being commercially available.

This embodiment, unlike other prior art, fits both right and left hand equally, meaning one size/shape fits all. This eliminates the need to have a left-handed version and a right-handed version and thus makes the device more commercially viable. This embodiment does not require that a user stop the game play and change the device depending on whether they want to use their right or left hand. In addition, it can be instantaneously adjusted when a player wants to change their grip from say a western grip to a continental grip, allowing effective top spin, under spin or the like and therefore not impede the user's ability to shift playing styles and techniques and making it a commercially viable option.

One of the issues in game play is that when a user swings, they must retain the racket at the end of the stroke, rendering the stroke less powerful than it would be if the user could let go of the racket. The requirement to grip the racket, lest it would fly out of their hand and across the court, causes the user to devote their attention and energy into the retention of the racket at the end of a stroke. This retention of the racket is not something that users are aware of because there has never been any other option but to grip the apparatus or racket handle and as a result it is commonly accepted that you have to grip the apparatus or racket handle and gripping is "what you have to do" so you don't send the racket flying across the court.

Therefore, the user can't take advantage of a full stroke, of any kind, and instead stops the stroke from going full force because of this need to grip the racket. In this embodiment, because the user has the choice to continue gripping the racket as they always have (old school method) or let go of the racket. With this choice, they are not encumbered by having to quickly learn something new (i.e., not gripping) and can ease into learning this new behavior and stroke at whatever learning pace is comfortable for them. The user does not have to grip the racket and gains an advantage in that strokes can be rendered with their full force, because the user is no longer concerned and preoccupied with the racket flying out of their hand.

In gripping the racket tightly so as to not lose a grip on it, the user looses the finesse of holding the racket correctly for specific shots, for example; but not limited to wrist pronation on a serve. Wrist pronation on a serve is when the user uses the wrist as a hinge point, it keeps the head and body straight in the air, resulting in more accurate shots by being able to more accurately hit the sweet spot.

The head and body alignment is critical in sports and directly affects game play. This embodiment allows for the perfect head-body alignment. In game play, the body follows the positioning of the head. The position of the head not only guides the rest of the body weight in an activity, it also determines the most effective weight distribution of the body when the racket impacts the ball. It's this weight distribution of the body, in part, which provides the velocity and power of a shot. So for instance, if one weighs 180 lbs, with the correct weight distribution, i.e., alignment of the head and body, the user has effectively 180 lbs of body weight for the shot. If the player "clubs" the ball or at impact, redistributes the body weight or head/body alignment in an less effective positioning, the result is something less than the 180 lbs of body weight available for the shot and results in a less powerful, slower shot.

A human head weighs approximately 11 pounds. If the 11 pounds of the head is motionless during play, then the player will have full use of the 11 pounds of the head to direct the rest of the body for full impact when the racket and the ball connect, which is the desired, maximum efficiency state. For example, in prior art when the user grips the racket, the natural inclination is for the user to use their shoulder, arm and chest to forcibly drive the ball, and whose action pulls the head out of the correct position and results in a "clubbing" action of the ball and an inferior shot. With this embodiment the user's need to grip the racket is gone and uniquely allows the user to use a hinged-wrist motion when hitting the ball. It's this hinged-wrist motion, which is difficult to impossible for even the most advanced player to obtain when gripping the racket, that eliminates the need for the player to use their shoulder, arm and chest in that clubbing action. With the clubbing action eliminated the head-body weight distribution is more easily aligned and the sweetspot zone affect ensues and produces superior shots.

The head and eye coordination in sports is extremely important in that the eyes must be optimally focused on the ball upon impact. During a serve or a swing, for more accuracy, to optimize the shot, the player must keep the head perfectly still or motionless during the swing so as to keep the eyes focused on the "square inch of the ball." The "square inch of the ball" is the area of the ball that the racket contacts during any stroke. So if the head is not motionless, then when the user is setting up to hit the sweet spot, the eyes which should be focused on the "square inch of the ball" are pulled away from that spot and that leads to a less accurate shot. In this embodiment, the head-eye coordination is more accurate and so is the shot because the user doesn't have to grip the racket, and this with the combined ability to now use a hinged-wrist motion and resulting in relaxed, overall state of being and mind eliminates the clubbing action.

Another object of this embodiment is the ability to provide the player with an added mental dimension of the game as experienced by players in football or baseball whereas quarterbacks or pitchers actually release the ball from their grasp. In this embodiment the same action, meaning the ability to completely release the racket can be accomplished. What this provides is a new perspective on the mental strategy of the game. Without this embodiment, the player must concentrate on maintaining a tight grasp of the racket. Maintaining a tight grasp on the racket not only causes strain on the users muscles, but also joints and can cause errors in stroke production. The ability to release the racket provides the user with increased confidence, clarity and ability to put their mental attention on the accuracy of the stroke whereas without this embodiment, their attention would go to keeping the racket from going out of control.

In gripping the racket so tightly, the user is focused on the grip and not able to effectively keep their eye on the ball. Because this embodiment does not require the user to control the racket, the user, regardless of whether the stroke is an overhead or a backhand or regular stroke or any stroke, has one less thing to think about, leaving their mind and body to focus on the ball. The ability to focus on the ball means that creativity, accuracy and placement of the ball and the shot are enhanced. This advances their game play capabilities so as to be more strategic about where to place the ball and to challenge the opponent and thus win more points.

The game of tennis has largely attracted a smaller audience as compared to other spots, in part, because of the difficulties in learning to play and to become good at it. This embodiment changes the "standing" of the game of tennis and the like, from a sport for an elite few to a game that is easier to play, less complicated, more enjoyable, easier to improve one's performance, easier to win points/game and therefore will drive more players to play, could increase the fitness of the world and those that embark on this path because the user does not have to expend mind concentration or physical energy on gripping the apparatus or racket handle.

The exponential increase in mental freedom and the resulting increased enthusiasm, excitement and creativity allows not only an experienced user to increase their ability to advance their game play, but it also and even more so has this affect on inexperienced players or young children or young adults. Young adults and children who are first introduced to a sport like tennis will often find it difficult to hold the racket, or painful because their young limbs and fingers have not developed the skill or capability for this activity. What results is that young players give-up playing the sport prematurely. This embodiment reduces these issues with young children, young adults, old adults or handicap or impaired person's in that it gives them a sense of fun and accomplishment so that they stick with the sport and don't give up so easily, and instead continue to play into adulthood.

In addition, older folks who have lost strength or have disabilities that impair their range of motion can be discouraged from playing a racket sport. This embodiment allows older folks to either pick up the sport at an older age or if they were a player when they were younger, then they will be able to continue to play for many more years than without these embodiments. This embodiment allows those with damaged limbs, like a rotator cuff or shoulder, wrist, finger injuries to play with less or no pain.

PRIOR ART STATEMENT

US Patents

U.S. Pat. No. 6,261,191 MULTI-SURFACE GRIP TAPE FOR APPARATUS; This invention relates in general to an improved grip tape for an apparatus, and is more specifically for tape that is applied to the grip of a tennis racket to enhance the shock absorption and traction capabilities of the tennis racket handle. Our embodiments differ in that instead of enabling the user/player to have a better grip on the apparatus or implement, our embodiments intentionally remove the need for the user to grip the implement.

U.S. Pat. No. 5,842,933 IMPLEMENT GRIP WITH BUILT-IN SHOCK ABSORBER; This invention relates to an implement grip having a built-in shock absorber with a coiled configuration or interspersed coils for implements ranging from sport equipment such as golf clubs, tennis rackets and baseball bats to tools such as hammer. Our embodiments differ in that instead of enabling the user/player to have a better grip on the apparatus or implement, our embodiments intentionally remove the need for the user to grip the implement.

U.S. Pat. No. 5,215,307 GOLF SWING TRAINING EXERCISE METHOD; This invention is based on training a user how to better grip the implement while maintaining their balance by using weights and counter weights, simulating the use of the implement. Our embodiments differ in that instead of enabling the user/player to practice maintaining their balance while gripping the implement, our embodiments intentionally removes the need for the user to grip the implement.

U.S. Pat. No. 5,070,856 HAND/BOW INTERFACE FOR ARCHERY BOW; This invention is based on providing an interface between the hand of the user and the implement, so when the user is holding, gripping, touching the implement the interface increases the accuracy of using the device as well as to reduce the friction at the bow-hand interface, causing undesirable alternation of the position of the bow in that the bow is no longer centered in the hand that grips the bow. Our embodiments intentionally remove the need for the user to grip the implement.

U.S. Pat. No. 6,974,626 SHOCK AND VIBRATION DAMPENING GRIP; This invention is based on providing a shock and vibration dampening grip as well as a waterproof grip wrap. Our embodiments intentionally remove the need for the user to grip the implement.

U.S. Pat. No. 7,276,000 TRAINING GRIP FOR A TENNIS RACKET; This invention is based on providing a device to train the user to grip the implement properly for the intended use. Our embodiments intentionally remove the need for the user to grip the implement.

U.S. Pat. No. 4,159,116 STRESS RELIEVING DEVICE; The device of this invention is intended to reduce the possibility of inflammation of the muscles in the vicinity of the elbow resulting from prolonged gripping by the user of the apparatus of tools, tennis rackets or the like. Our embodiments intentionally remove the need for the user to grip the implement.

U.S. Pat. No. 1,587,287 HAND GRIP FOR GOLF CLUBS OR THE LIKE; This invention is for a grip attachment with connectors for the fingers, where the connectors couple to a mechanism for coupling to an apparatus to assist in gripping for tennis or golf club or the like. Our embodiments intentionally remove the need for the user to grip the implement.

U.S. Pat. No. 4,226,418 GAME RACKET HAND GRIP; This patent is a hand grip for a game racket, which requires the player to removes the end of the racket, put the invention on the racket and then replace the end of the racket back onto the racket. Our embodiments intentionally removes the need for the user to grip the implement and does not require that the racket apparatus or any part of the racket be adjusted or removed.

U.S. Pat. No. 5,704,845 GOLF CLUB TEACHING AND GRIPPING DEVICE; This patent consisting of a golf club gripping portion and is not usable for tennis. Our embodiments intentionally removes the need for the user to grip the implement. The device is designed to work with a golf club, which are much thinner than for example, a tennis racket and if this device were to be applied to tennis, it would have to be much larger than the device for golf club making the overall, combined apparatus and device width so large that when the player had it in hand, it would greatly interfere with the intended use of the implement and decreasing the quality of play. Additionally, the device does not allow for any apparatus positioning adjustments, as does the current embodiments that allow for instantaneous micro-adjustments on a continuous basis using the suspension apparatus necessary for quality play. The device, when in the palm of the hand, positions the apparatus of the implement in the hand of the user at a 90 degree angle or perpendicular to the fingers. Whereas what is required in tennis-type deployments, is the positioning of the apparatus in the palm on a ~45 degree angle compared to the fingers. For these and other reasons makes the U.S. Pat. No. 5,704,845 unusable for tennis-type interactions.

U.S. Pat. No. 6,945,874 GRIPPING DEVICE; This patent is for a gripping device for use with the hand of a user. Our embodiments intentionally remove the need for the user to grip the implement.

U.S. Pat. No. 3,227,455 GOLF CLUB GRIP INCLUDING FINGER GROOVES AND GUARD ELEMENT; This patent relates to an attachment in the form of a grip for us with the shafts or apparatus of golf clubs, where the user still must grip the apparatus. Our embodiments intentionally remove the need for the user to grip the implement.

U.S. Pat. No. 3,712,618 TENNIS RACKET ATTACHMENT; This patent is for a brace and locator to assist a tennis player in gripping a conventional tennis racket and requires physical changes to the racket to implement. Our embodiments intentionally remove the need for the user to grip the implement and do not require any changes to the racket.

U.S. Pat. No. 4,128,240 TENNIS RACKET; This patent is for a tennis racket grip where a finger hole is drilled into the racket Apparatus, which means the racket handle has to be modified and this modification will disintegrate the structural integrity of the racket strength. Our embodiments intentionally remove the need for the user to grip the implement and does not require the user to drill a hole in the racket and stick their finger through the hole.

U.S. Pat. No. 6,299,557 RACKET GRIPPING DEVICE; This invention is for a device for use in gripping a tennis racket or the like to maintain a proper grip on the Apparatus of a tennis racket. Our embodiments intentionally remove the need for the user to grip the implement.

Foreign Patents

WO 2007/061540/PCT/US2006/040582 TENNIS TRAINING AID; This invention is for a tennis training device comprised of a forearm attachment and a wrist positioning member to teach the player a variety of tennis strokes and requires the player to grip the racket handle. Our embodiments intentionally remove the need for the user to grip the implement.

PCT/US2010/001422 GRIPPING DEVICE FOR HANDLES; This invention relates to a gripping device for handles, and particularly for racket handles. Our embodiments intentionally remove the need for the user to grip the implement.

EP 2 103 331 A1/08169076.0 METHOD FOR MODIFYING A TENNIS RACKET; This invention relates to a modified handle of a tennis racket equipped with an ergonomic stabilizer grip to better key a grip on the racket during play. Our embodiments intentionally remove the need for the user to grip the implement.

01 109 367 A1/83830213.1 TENNIS RACKET HANDLE STRUCTURE; This invention relates to a tennis racket handle with axially extended holes and radially extended smaller holes to enable the user a firm grip. Our embodiments intentionally remove the need for the user to grip the implement.

BRIEF SUMMARY OF THE INVENTION

The suspension system generally includes flexible suspension connector(s), stabilizers, adjustable finger devices and an adjustable thumb device and/or a glove that altogether becoming a suspension system.

There has thus been outlined, rather broadly, some of the features of the embodiments in order that the detailed description thereof may be better understood, and in order that the present contribution to the art may be better appreciated. There are additional features of the embodiments that will be described hereinafter.

In this respect, before explaining at least one embodiment of the apparatus in detail, it is to be understood that the embodiments are not limited in its application to the details of construction or to the arrangements of the components set forth in the following description or illustrated in the drawings. The apparatus is capable of other embodiments and of being practiced and carried out in various ways for other professions and applications, including but not limited to medicine, (e.g. dentistry, surgery) carpentry, sports, mechanics, etc. Also, it is to be understood that the phraseology and terminology employed herein are for the purpose of the description and should not be regarded as limiting.

One embodiment is made up of flexible suspension connectors, adjustable finger connector(s) and an adjustable thumb connector altogether becoming a suspension system for the apparatus. Another embodiment has only one finger connection on the index finger and the thumb. In another embodiment, there can be a finger connection on one, two, three or all of the fingers and the thumb. In another embodiment, there is a glove-type apparatus that acts as the finger connectors and there is a connector on the thumb. In this embodiment, there are also many types of suspension systems for the handle of an implement. One particular embodiment of the suspension system is made up of between one and four flexible connectors in which the handle is inserted inside of the connector system and the handle rests within the cove of the hand in the area between the thumb, the palm and the index finger. Another embodiment of the suspension system is made up of between one and four flexible connectors in which the handle or apparatus is suspended between the connector and the area making up the cove of the hand in the area between the thumb, the palm and the index finger.

One object of a particular embodiment provides a racquet suspension system for eliminating the need for the user to directly grasp, grip or clench any apparatus (i.e. instrument, device, tennis racquet, squash racquet, racquetball racquet, badminton racquet, lacrosse stick, hammer, etc), by producing an apparatus suspension system and eliminating any amount of pressure required from the user's hand, fingers and the like and solves many long felt, long-existing and unsolved needs.

Another object of the present embodiment is to overcome difficulties faced in normal use of devices with handles by providing a light, self-adjusting suspension-type structure which can be attached to any user's hand (child or adult) and any handle without making any changes or adjustments to the physical structure of the apparatus or handle itself, and allow complete sensitivity to a user's hand while comfortably fitting any hand, and which has adequate strength and control of the device so as to keep the device from leaving the user's hand while under causal to extreme motion and when the device comes into contact with a member, such as a ball, the aforementioned embodiment does not cause irritation or trauma to the user, as in, but not limited to the user's hand, arm, shoulder, as well as all parts of the body and in addition, and at the same time can increase the capability of the user when employing the suspension system.

In this particular description that follows, this embodiment is applied to racket sports, but it should be understood that it applies to any apparatus or implement in any situation. Another object is to provide a suspension system that allows the user to suspend for instance, a racquet handle in the palm and enable a rocking effect of the racquet handle in the palm, while concurrently producing acceleration of the racquet head speed and reducing or eliminating tension or irritation caused by the typical gripping of the sports racquet handle.

Another object is to provide an apparatus or handle suspension system that enables the user to accelerate the racquet head speed by suspending the apparatus, reducing vibrational force and having a recoil effect on the hand, wrist and arm, and reducing the likelihood of arm, wrist or hand or bodily injury.

Another object is to provide an apparatus suspension system that reduces the need for two-handed backhand grip of the handle increasing racquet control and the user's reach with the tennis racquet and enables the user to connect with the ball faster and with more accuracy, giving the user an added advantage that could not occur without the embodiment because of the difficulty in executing an accurate stroke with a two-handed backhand grip.

Another object is to provide an apparatus or handle suspension system that reduces the need to manage the racquet grip under continuous match play conditions, enabling faster and more accurate maneuvers and the ability to play longer sets without becoming tired or injured, and thus giving the user another physical advantage in game play regardless of age or gender.

Another object is to provide an apparatus or handle suspension system that enables the user to actually pronate their wrist without pain and therefore hit the serve correctly instead of using the racket as a "club" which results in a minimum speed and less control of the ball. Wrist pronation without this embodiment is very awkward and unnatural. Most players don't pronate their wrists and use the racket as a club instead of using the racket in a throwing motion. The ability to provide the user with a method to easily pronate their wrists and throw the racket without loosening it means the difference between winning and loosening the serve and the point.

Another object is to provide an apparatus suspension system that reduces grip pressure required by the user's hand to hold the racquet apparatus, thereby potentially aiding people with tennis elbow, or other disabling conditions to be able to grip a racquet handle with minimal effort, reducing their experience of irritation, pain and injury and allowing them to play tennis when without the embodiment they might have to give up playing altogether.

Another object is to provide an apparatus suspension system that helps to increase the kick, velocity and centrifugal force on the ball by suspending the racquet handle during a top spin serve and the slice serve, making it more difficult for an opponent to return the ball and increasing the likelihood of winning the point or game as well as increasing their standings compared to competitors.

Another object is to provide an apparatus suspension system that provides the user with advantages over their opponent because the user without the suspension system has to expend additional mental focus and physical energy to manage the racquet. What happens without the embodiment is that the user often generates less racquet head speed, has less control over the racquet head, requires more mental focus on gripping and controlling the racket and more has to expend more mental focus on the strategic nature of setting up and executing game play. In this embodiment a user has a mental advantage over those without the apparatus suspension system, increasing the likelihood of winning the point or game.

Another object is to provide a suspension system that stabilizes the control of the racquet positioning enabling more shot accuracy because once positioned; the apparatus suspension system more easily retains that positioning than if the user gripped the racket with the hand during the stroke and ball impact.

Another object is to provide an apparatus suspension system that enables the user to receive support in positioning and holding the racquet in the hand yet allows the user to quickly make and accurately retain micro adjustments of the racquet for various positions required during play.

Another object is the self-adjusting suspension-type structure that enables the pressing the bell of the racket handle against the palm of the user's hand, keeping the racket from slipping out of the user's grasp.

Another object is to provide an handle suspension system that with the racquet handle loosely suspended in the hand enables that ability to rock the racquet handle and racquet head producing another type of stroke that otherwise cannot be produced without the embodiment, for instance, but not limited to a slam shot and is a hinged-wrist supported action.

Other objects and advantages of the present embodiment will become obvious to the reader and it is intended that these objects and advantages are within the scope of the present embodiments. To the accomplishment of the above and related objects, this embodiment may be embodied in the form illustrated in the accompanying drawings, attention being called to the fact, however, that the drawings are illustrative only, and that changes may be made in the specific construction and materials illustrated and described within the scope of this application.

BRIEF DESCRIPTION OF THE DRAWINGS

Various other objects, features and attendant advantages of the present embodiment will become fully appreciated as the same becomes better understood when considered in conjunction with the accompanying drawings, in which like reference characters designate the same or similar parts throughout the several views, and wherein:

FIG. 1 is a side view of the Flexible Suspension Connector.

FIG. 2 is an above flat view of the Adjustable Index Finger Connector.

FIG. 3 is a backside view of the Adjustable Index Finger Connector.

FIG. 4 is an above flat view of the Adjustable Thumb Connector.

FIG. 8 is an above flat view of the Flexible Ring Suspension Connector.

DETAILED DESCRIPTION OF THE DRAWINGS AND THE PRESENTLY PREFERRED EMBODIMENTS

Overview

Figure 1:
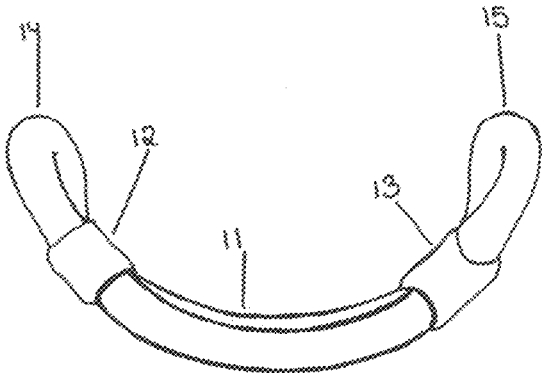
FIGS. 1-4 show a Disassembled View of the present embodiment, showing four separate figures depicting a disassembled view of the main elements of the embodiment.

Turning now descriptively to the drawings, in which similar reference characters denote similar elements throughout the several views, the figures illustrate a flexible suspension connector, an adjustable index finger connector and an adjustable thumb connector and/or a glove altogether becoming an handle or apparatus suspension system.

INDEX OF ELEMENTS

10: Flexible Suspension Connector
11: Main Suspension Connector
12: First Suspension Connector Stabilizer
13: Second Suspension Connector Stabilizer
14: First-End Suspension Connector
15: Second-End Suspension Connector
20: Adjustable Index Finger Connector
21: Index Finger Connector Fastener
22: Index Finger Connector Strap
23: Index Finger Connector Suspension Connector
24: Index Finger Connector Strap End
25: Index Finger Connector Fastener Hole One
26: Index Finger Connector Fastener Hole Two
27: Index Finger Connector Fastener Hole Three
28: Index Finger Connector Fastener Hole Four
29: Index Finger Connector Fastener Hole Five
30: Backside View of Adjustable Index Finger Connector
31: Index Finger Connector Fastener Fold Backside
32: Index Finger Connector Strap
33: Index Finger Connector Suspension Connector
40: Adjustable Thumb Connector
41: Thumb Connector Fastener
42: Thumb Connector Strap
43: Thumb Connector Suspension Connector
44: Thumb Connector Strap End
45: Thumb Connector Fastener Hole One
46: Thumb Connector Fastener Hole Two
47: Thumb Connector Fastener Hole Three
48: Thumb Connector Fastener Hole Four
49: Thumb Connector Fastener Hole Five
50: Complete View—Apparatus Suspension System
10: Flexible Suspension Connector
14: First-End Suspension Connector
15: Second-End Suspension Connector
20: Adjustable Index Finger Connector
23: Index Finger Suspension Connector
40: Adjustable Thumb Connector
43: Thumb Suspension Connector
60: Operational View—Apparatus Suspension System With Racquet and Hand
10: Flexible Suspension Connector
20: Adjustable Index Finger Connector
40: Adjustable Thumb Connector
61: Racquet Apparatus Top
62: Thumb
63: Hand
64: Index Finger
65: Racquet Apparatus Bottom
70: Operational View—Apparatus Suspension System
10: Flexible Suspension Connector
14: First-End Suspension Connector
15: Second-End Suspension Connector
20: Adjustable Index Finger Connector
23: Index Finger Suspension Connector
40: Adjustable Thumb Connector
43: Thumb Suspension Connector
80: Flat view of the Flexible Suspension Connector
66: Flexible Suspension Connector
67: First-End of the Suspension Connector
68: Second-End of the Suspension Connector
90: Operational View of the Apparatus Suspension System
20: Adjustable Index Finger Connector
23: Index Finger Suspension Connector
40: Adjustable Thumb Connector
43: Thumb Suspension Connector
66: Flexible Suspension Connector
67: First-End of the Suspension Connector
68: Second-End of the Suspension Connector
69: The Middle Finger Suspension Connector
70: The Index Finger Suspension Connector
71: The Pinky Finger Suspension Connector
100: Operational View of the Apparatus Suspension System
23: Index Finger Suspension Connector
43: Thumb Suspension Connector
66: Flexible Suspension Connector
67: First-End of the Suspension Connector
68: Second-End of the Suspension Connector
69: The Middle Finger Suspension Connector
70: The Index Finger Suspension Connector
71: The Pinky Finger Suspension Connector
72: Glove

110: Operational View of the Apparatus Suspension System
10: Flexible Suspension Connector
14: First-End Suspension Connector
15: Second-End Suspension Connector
23: Index Finger Suspension Connector
43: Thumb Suspension Connector
70: The Index Finger Suspension Connector
71: The Pinky Finger Suspension Connector
72: Glove
120: Operational View of the Apparatus Suspension System
20: Adjustable Index Finger Connector
23: Index Finger Suspension Connector
40: Adjustable Thumb Connector
43: Thumb Suspension Connector
66: Flexible Ring Suspension Connector
67: First-End of the Suspension Connector
68: Second-End of the Suspension Connector
70: The Ring Finger Suspension Connector
69: The Middle Finger Suspension Connector
71: The Pinky Finger Suspension Connector
73: Handle of An Apparatus Flexible Suspension Connector The Flexible Suspension Connector is suspended between the thumb and the index finger of the hand that holds the implement. In use with tennis (but not limited to just tennis), the racquet handle is inserted between the palm of the hand and the Flexible Suspension Connector. The Flexible Suspension Connector can float around the racquet handle and varying pressures can be applied to the racquet handle by the thumb and fingers as needed. The floating, suspension action of the racket handle allows the user to position the racquet for all conventional tennis grip positions. Since the racquet is suspended and held in place by the Flexible Suspension Connector, the user has the option to apply or not apply force on the apparatus, yielding performance advantages. The Flexible Suspension Connector is made of a strong, flexible material so as to fit any racquet handle or apparatus.

Referring to the connectors in the Figures, the Flexible Suspension Connector is shown in FIG. 1. The Main Suspension Connector (11) is one of the main sub-elements of the Flexible Suspension Connector (10). The Main Suspension Connector (11) has two ends, First-End Suspension Connector (14) and the Second End Suspension Connector (15). The Main Suspension Connector (11) has stabilizer, First Suspension Connector Stabilizer (12) and the Second Suspension Connector Stabilizer (13). The Main Suspension Connector (11) and Suspension Connector Stabilizer (12) and (13) may be made of a variety of materials.

Adjustable Index Finger Connector

Figure 2:
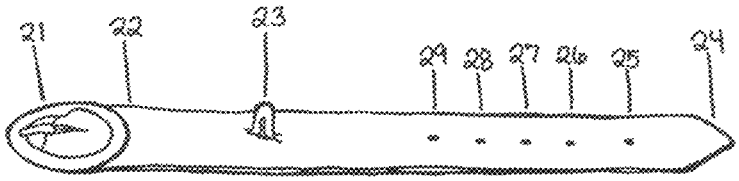

Adjustable Index Finger Connector, FIG. 2, is attached to the Flexible Suspension Connector. There is an Adjustable Index Finger Connector for the index finger and an Adjustable Thumb Connector for the thumb. The Adjustable Index Finger Connector is made from a supple material equipped with a small fastener to adjust the Index Finger Connector for any size finger. The Adjustable Index Finger Connector is attached to one end of the Flexible Suspension Connector and the Adjustable Thumb Connector is connected at the other end of the Flexible Suspension Connector. The Adjustable Index Finger Connector is approximately one half inch wide and long enough to circle the index finger and is thin enough to allow contact of the user's hand to the apparatus.

Referring to the Figures, the Adjustable Index Finger Connector is shown in FIG. 2. The Index Finger Connector Strap (22) is one of the main sub-elements of the Adjustable Index Finger Connector (20).

The Index Finger Connector Strap (22) in FIG. 2 is of a fixed length. It has two ends to it. At one end is the Index Finger Connector Fastener (21) and at the opposite end is the Index Finger Connector Strap End (24). Nearest to the Index Finger Connector Strap End (24) is a series of fastener holes drilled into the strap; Index Finger Connector Fastener Hole One (25), Index Finger Connector Fastener Hole Two (26), Index Finger Connector Fastener Hole Three (27), Index Finger Connector Fastener Hole Four (28), Index Finger Connector Fastener Hole Five (29). An Index Finger Connector (23) is mounted into the Index Finger Connector Strap (22) at a specific distance between the Index Finger Connector Fastener (21) and the Index Finger Connector Fastener Hole Five (29).

The Adjustable Index Finger Connector Fastener (21) and the Index Finger Connector Strap (22) may be made of a variety of materials. Other structural variations to the Adjustable Index Finger Connector (20) may use other materials such as Velcro-like, nylon metal, plastic, ceramic connector and fastener materials.

The Index Finger Connector (23) may be made of a variety of materials. The Index Finger Connector Strap End (24) may be cut in the shape of a ">."

Backside View Of Adjustable Index Finger Connector

This is the backside view of the Adjustable Index Finger Connector. A supple material covers the connector backside and holds the connector that connects to the Flexible Suspension Connector to the Adjustable Index Finger Connector, as this backside side comes in contact with the skin on the hand.

Figure 3:
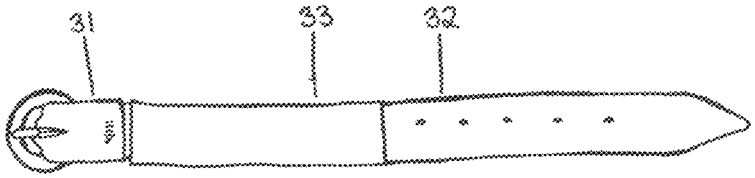

Referring to the Figures, Page 1—the Backside View of Adjustable Index Finger Connector is shown in FIG. 3. The backside of the Index Finger Connector Strap (32) is a main sub-element and applies to both the backside of the Adjustable Index Finger Connector (20) and the backside of the Adjustable Thumb Connector (40). The Index Finger Connector Fastener Backside (31) depicts a view of how the Index Finger Connector Fastener (21) is inserted into the Index Finger Connector Strap (32), then the Index Finger Connector Strap (32) is folded and attached to itself to connect the Index Finger Connector Fastener (21). The Index Finger Connector Suspension Cover (33) is applied to the Index Finger Connector Strap—backside (32) in order to cover the backside attachment area of the Index Finger Connector Suspension Connector (23). The Index Finger Connector Suspension Connector Cover (33) may be made of a variety of materials.

Other structural variations to the Adjustable Index Finger Connector (20) and/or the Adjustable Thumb Connector (40) may use other materials such as velcro-like, nylon metal, plastic, ceramic connector and fastener materials. The Thumb Connector Strap End (44) may be cut in the shape of a ">."

Adjustable Thumb Connector

Adjustable Thumb Connector is attached to the Flexible Suspension Connector. The Adjustable Thumb Connector is made from a supple material equipped with a small connector to adjust the Thumb Connector for any size thumb. The Adjustable Thumb Connector is approximately one half inch wide and long enough to circle the thumb and is thin enough to allow contact of the user's hand to the apparatus.

Figure 4:
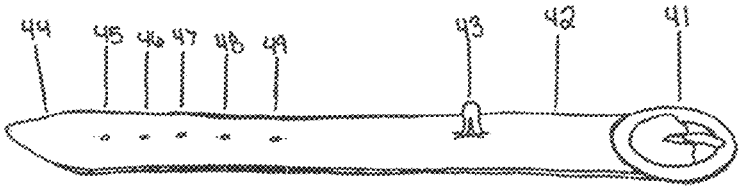

Referring to the Figures, Page 1—the Adjustable Thumb Connector is shown in FIG. 4. The Thumb Connector Strap (42) is one of the main sub-elements of the Adjustable Thumb Connector (40).

The Thumb Connector Strap (42) is of a fixed length and has two ends. At one end is the Thumb Connector Fastener (41) and at the opposite end is the Thumb Connector Strap End (44). Nearest to the Thumb Connector Strap End (44) is a series of fastener holes drilled into the strap; Thumb Connector Fastener Hole One (45), Thumb Connector Fastener Hole Two (46), Thumb Connector Fastener Hole Three (47), Thumb Connector Fastener Hole Four (48), Thumb Connector Fastener Hole Five (49). A Thumb Suspension Connector (43) is mounted into the Thumb Connector Strap (42) at a specific distance between the Thumb Connector Fastener (41) and the Thumb Connector Fastener Hole Five (49).

The Thumb Connector Fastener (41) and the Thumb Connector Strap (42) may be made of a variety of materials.

The Thumb Suspension Connector (43) may be made of a variety of materials. The Thumb Connector Strap End (44) is cut the shape of a ">."

Complete View—Apparatus Suspension System

Figure 5:
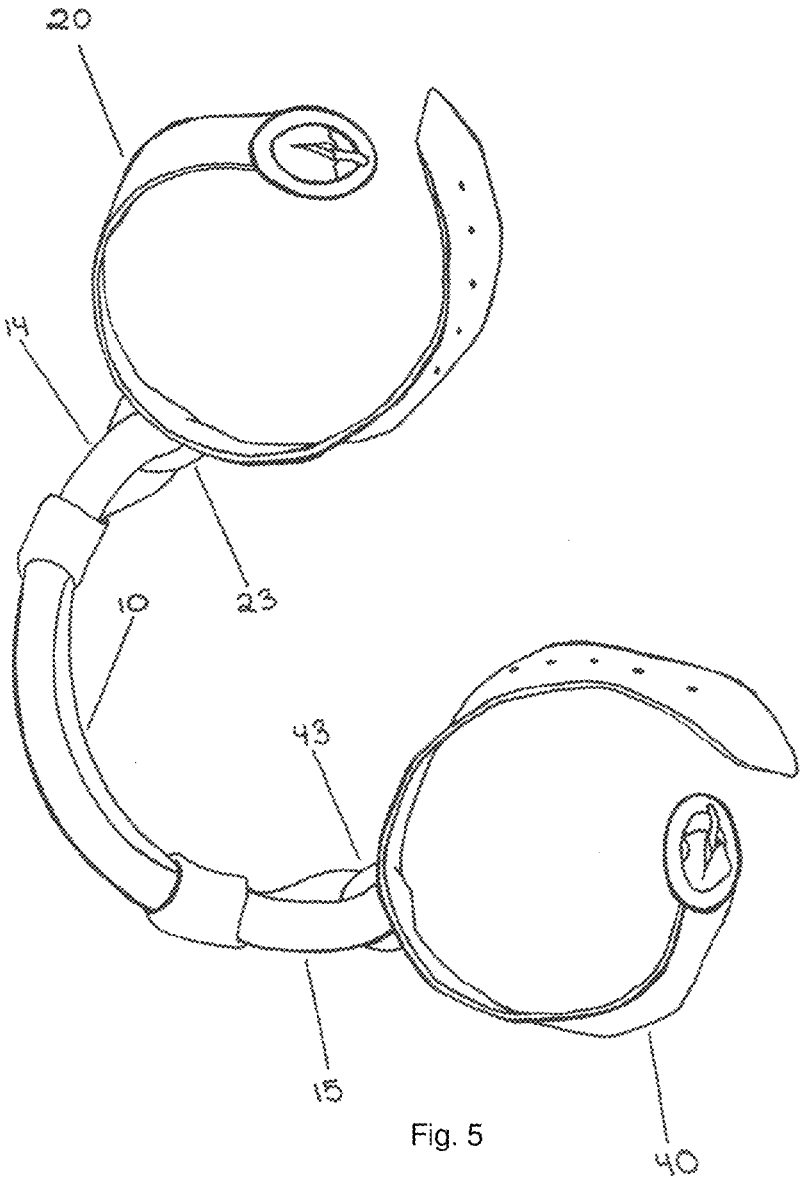
FIG. 5 shows a Full Side View of the fully assembled embodiment.

Referring to the Figures, Page 2—Complete View—Apparatus Suspension System is shown in FIG. 5 showing the completed view of Apparatus Suspension System in its entirety. It contains one Flexible Suspension Connector (10), one Adjustable Index Finger Connector (20) and one Adjustable Thumb Connector (40) at the opposing end of the Flexible Suspension Connector (10). Connection points for the main elements are: First-End Suspension Connector (14) connects to Index Finger Connector Suspension Connector (23). Second End Suspension Connector (15) connects to Thumb Connector Suspension Connector (43).

The Apparatus Suspension System (50) may be made of a variety of materials. Other structural variations to the Apparatus Suspension System (50) may use other main element materials or other related sub-element materials or other connecting materials.

Operational View—Apparatus Suspension System with Hand and Apparatus

This is a view of the Apparatus Suspension System shown in actual use attached to the hand and the apparatus inserted between the palm of the hand and the Flexible Suspension Connector.

Figure 6:
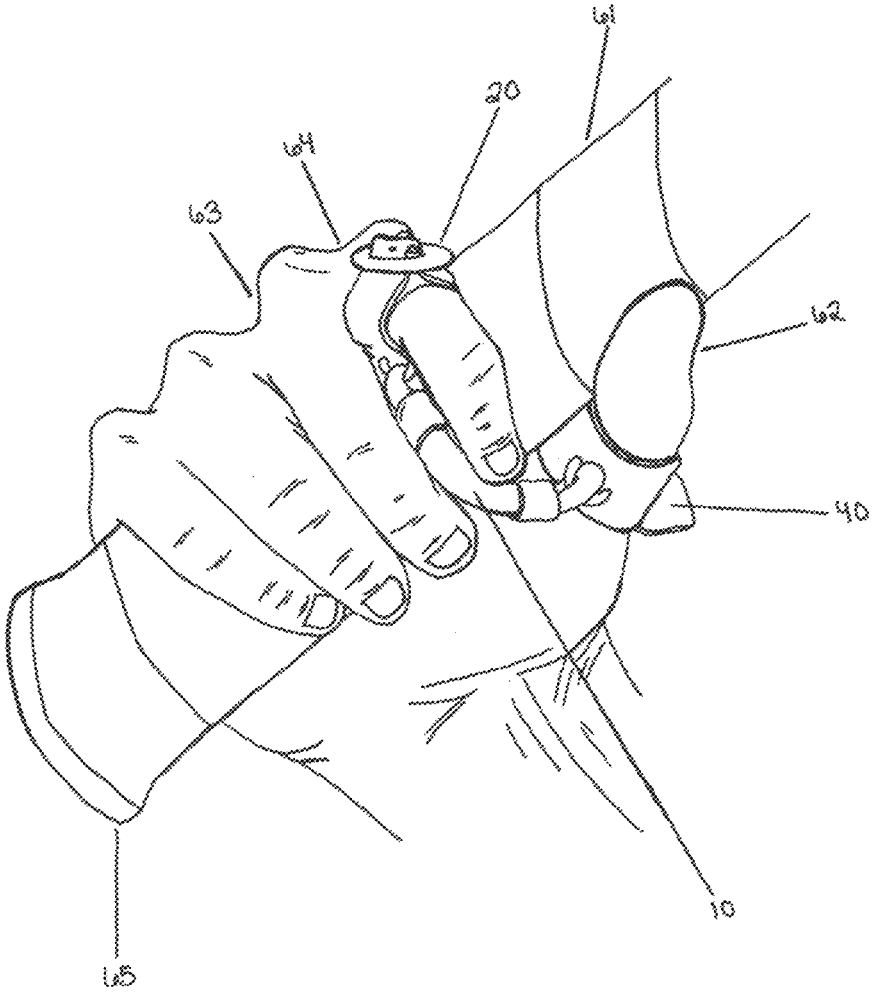
FIG. 6 is an Operational View of the present embodiment, showing the full embodiment in operational mode suspending a sports racquet Apparatus in a hand.

Referring to the Figures, Page 3—Operational View—Apparatus Suspension System with Apparatus and Hand is shown in FIG. 6 showing the operational view of Apparatus Suspension System in use. The Apparatus Suspension System contains one Flexible Suspension Connector (10), one Adjustable Index Finger Connector (20) and one Adjustable Thumb Connector (40). The top of the apparatus is located at (61). The bottom of the apparatus is located at (65). The thumb is located at (62). The entire hand gripping the apparatus is featured at (63). The index finger is located at (64). The bottom of the apparatus (65) is inserted between the palm of the hand and the Flexible Suspension Connector (10) and the apparatus is pushed to the desired location.

The Apparatus Suspension System with Adjustable Finger Connectors on Several Fingers.

Figure 7:
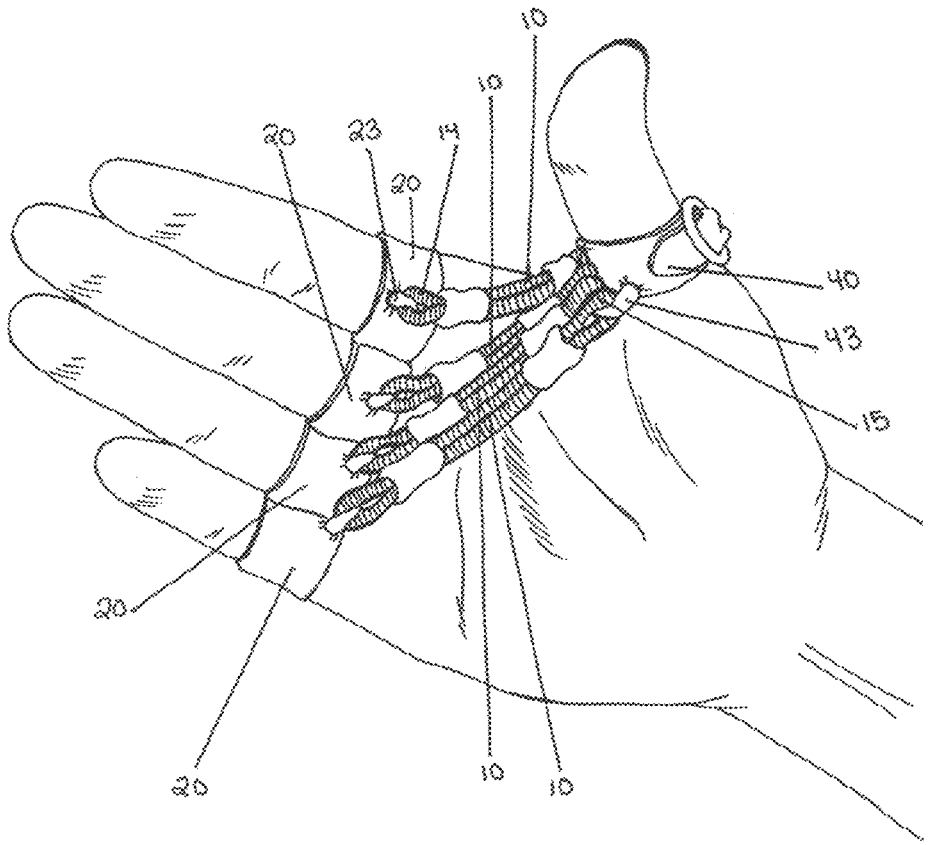
FIG. 7 is an Operational View of the present embodiment, showing the embodiment in operational mode with Adjustable Finger Connectors on several fingers.

Referring to the Page 4, The Apparatus Suspension System with Multiple Connectors is shown in FIG. 7 showing the completed view of the Apparatus Suspension System in its entirety. It contains several Adjustable Index Finger Connectors (20) which could include one, two, three or four fingers and one Adjustable Thumb Connector (40) at opposing ends of the Flexible Suspension Connector (10). Connection points for the main elements are: First-End Suspension Connector (14) connects to The Finger Connection. Suspension Connector (23). And this is repeated for the other fingers. The Second-End of the Suspension Connector (15) connects to the Thumb Connector Suspension Connector (43). The Apparatus Suspension System may be made of a variety of materials. Other structural variations to the Apparatus Suspension System (50) may use other main elements or materials or other related sub-element materials or other connecting materials.

Figure 8:
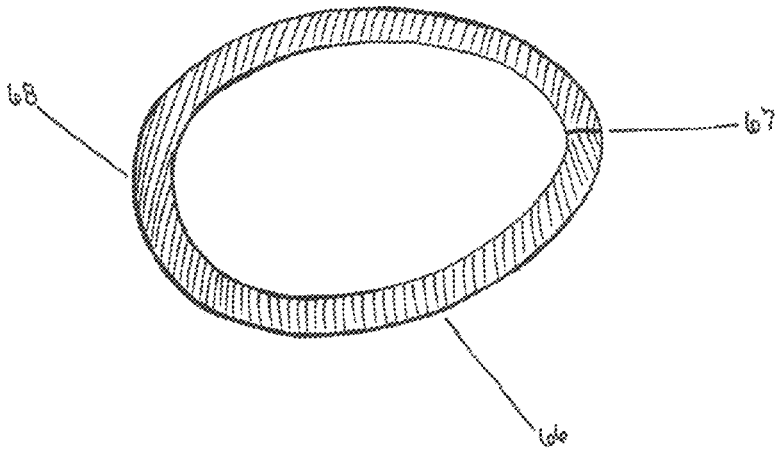
FIG. 8 is a Disassembled View of the present embodiment, showing one separate figure depicting a disassembled view of the one of main elements of the embodiment.

Referring to the Page 5, a Disassembled View of the present embodiment, showing one separate figure depicting a disassembled view of the one of main elements of the embodiment shown in FIG. 8 is an above flat view of the Flexible Ring Suspension Connector. The Flexible Ring Suspension Connector (66) has two ends, the First-End of the Flexible Ring Suspension Connector (67) and the Second-End of the Flexible Ring Suspension Connector (68). The Flexible Ring Suspension Connector (66) maybe made of a variety of materials.

Figure 9:
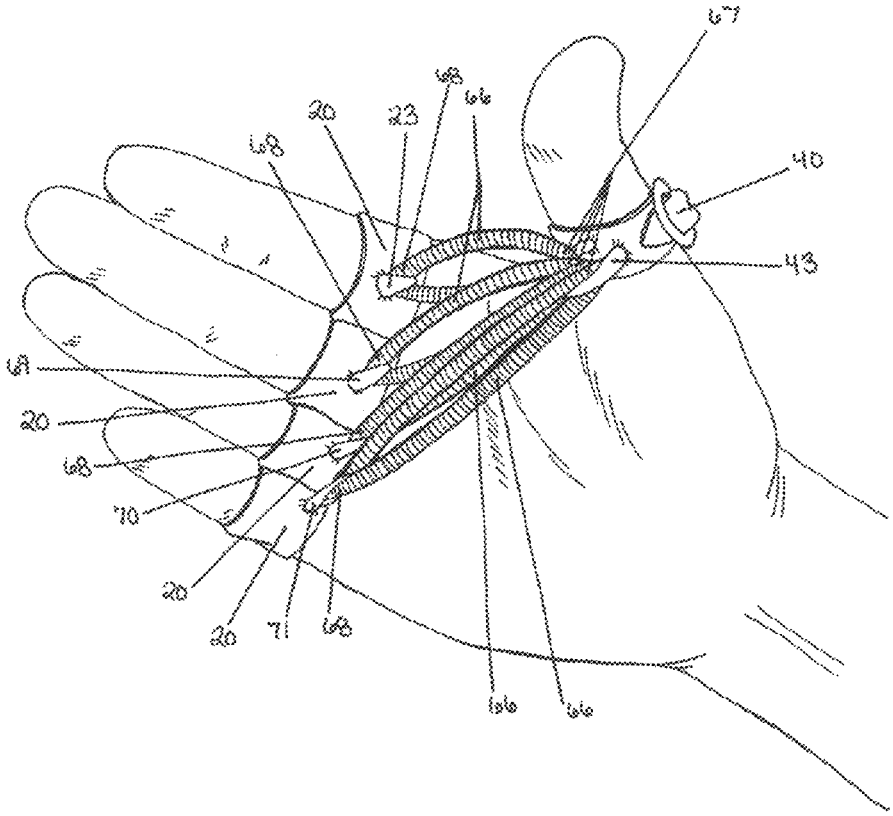
FIG. 9 is an Operational View of the present embodiment, showing the embodiment in operational mode with Adjustable Finger Connectors on several fingers with Flexible Suspension Connectors.

Referring to the Page 6, Shows the embodiment with the Adjustable Finger Connectors (20) on one or more Flexible Suspension Connectors (66) in as seen in FIG. 9 showing another version of the completed view of the Apparatus Suspension System in its entirety. It contains several Adjustable Finger Connectors (20) which could include one, two, three or four fingers—at The Index Finger Connector Suspension Connector (23), at the Middle Finger Connector Suspension Connector (69), at the Connector Finger Connector Suspension Connector (70) and the Pinky Finger Connector Suspension Connector (71) and one Adjustable Thumb Connector (40) at opposing ends of the Flexible Suspension Connector (66). Connection points for the main elements are: First-End Suspension Connector (67) connects to The Finger Connection Suspension Connector (23). And this is repeated for the other fingers. The Second-End of the Suspension Connector (68) connects to the Thumb Connector Suspension Connector (43). The Apparatus Suspension System may be made of a variety of materials. Other structural variations to the Apparatus Suspension Connector (66) may use other main elements or materials or other related sub-element materials or other connecting materials.

Figure 10:
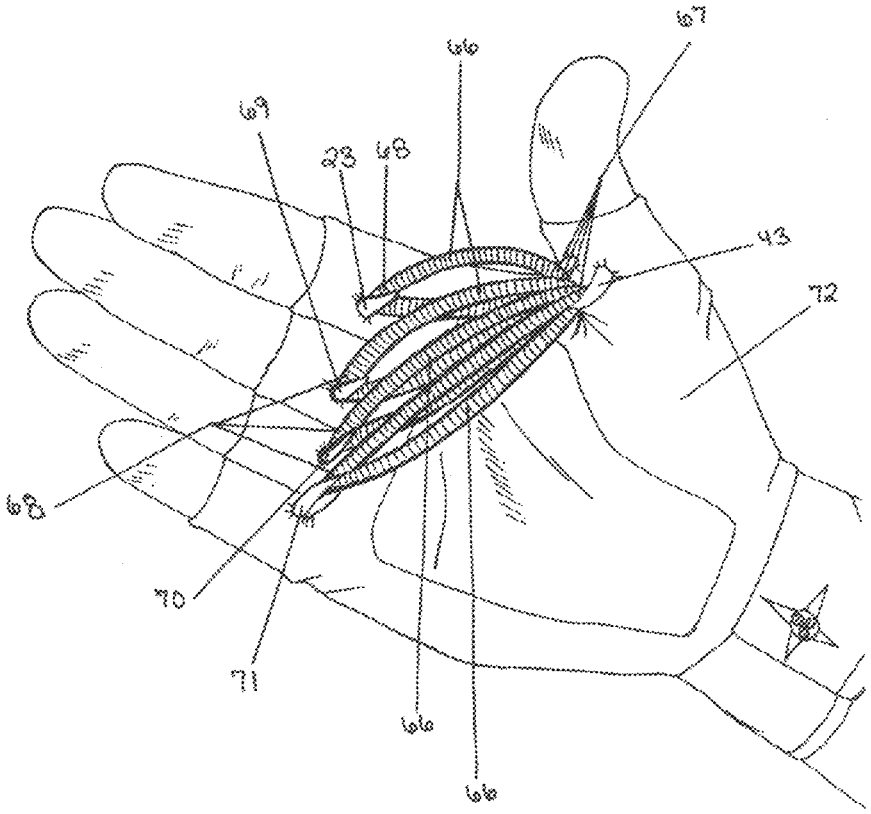
FIG. 10 is an Operational View of the present embodiment, showing the embodiment in operational mode with a Glove with Connectors on several fingers with Flexible Suspension Connectors.

Referring to the Page 7—is a view of the present embodiment, showing the embodiment with a Glove With Connectors (72) on several fingers with Flexible Suspension Connectors (66) in as seen in FIG. 10 showing another version of the completed view of the Apparatus Suspension System in its entirety. It contains several Adjustable Finger Connectors via the Glove (72) which could include four fingers and the thumb. Connection points for the main elements are: First-End of the Suspension Connector (67) connects to The Glove (72) at The Index Finger Connector Suspension Connector (23), at the Middle Finger Connector Suspension Connector (69), at the Ring Finger Suspension Connector (70) and the Pinky Finger Connector Suspension Connector (71). The Second-End of the Suspension Connector (68) connects to the Thumb Connector Suspension Connector (43). The Apparatus Suspension System may be made of a variety of materials. The preferred materials in this embodiment have been previously noted for each main element and sub-element. Other structural variations to the Apparatus Suspension Connector (66) may use other main elements or materials or other related sub-element materials or other connecting materials.

Figure 11:
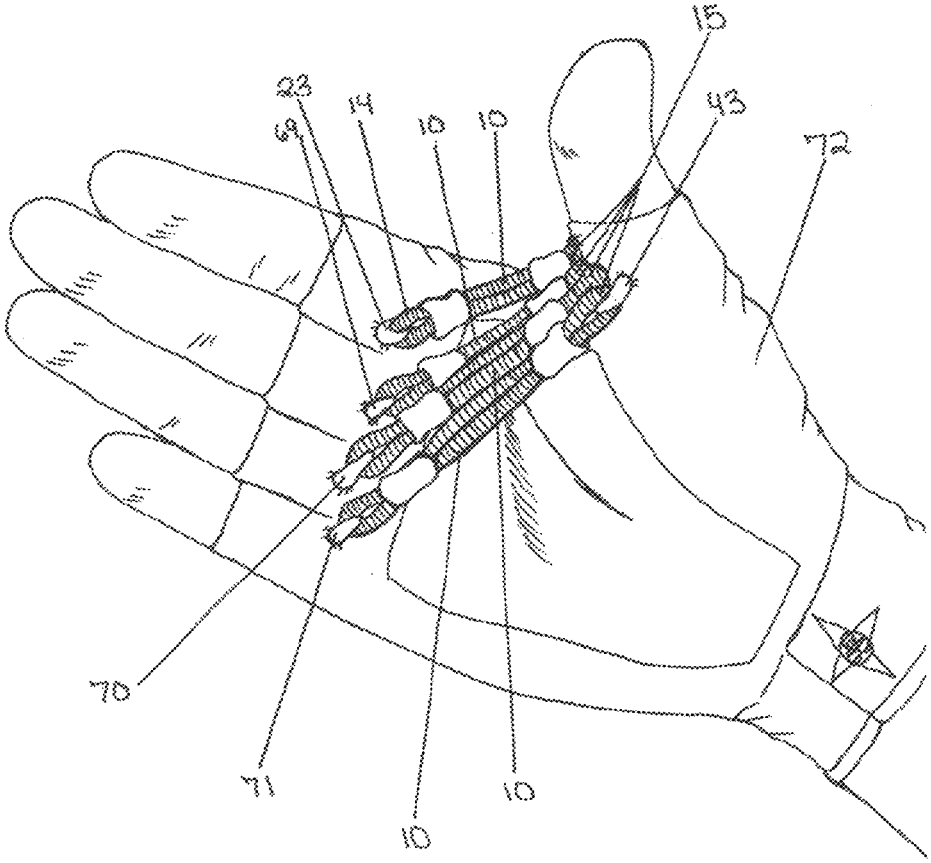
FIG. 11 is an Operational View of the present embodiment, showing the embodiment in operational mode with a Glove with Connectors on several fingers with Flexible Suspension Connectors.

Referring to the Page 8: is an view of the present embodiment, showing a Glove With Connectors (72) on four fingers with Flexible Suspension Connectors (11) in as seen in FIG. 11 showing another version of the completed view of the Apparatus Suspension System in its entirety. The Glove (72) has Flexible Suspension Connectors (11) connected from The Index Finger Connector Suspension Connector (23), at the Middle Finger Connector Suspension Connector (69), at the Connector Finger Connector Suspension Connector (70) and the Pinky Finger Connector Suspension Connector (71) and one Adjustable Thumb Connection (43). Connection points for the main elements are: First-End Suspension Connector (14) connects to The Index Finger Suspension Connector (23). The Second-End of the Suspension Connector (15) connects to the Thumb Connector Suspension Connector (43). The Apparatus Suspension System may be made of a variety of materials. The preferred materials in this embodiment have been previously noted for each main element and sub-element. Other structural variations to the Apparatus Suspension Connector (66) may use other main elements or materials or other related sub-element materials or other connecting materials.

Figure 12:
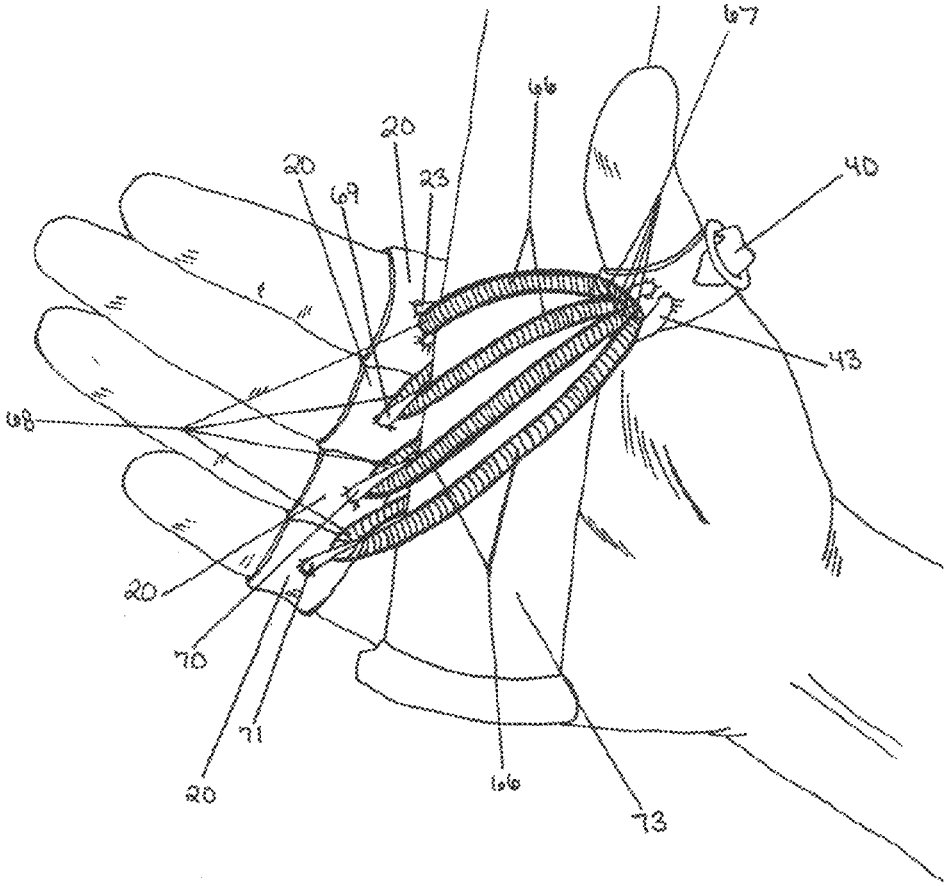
FIG. 12 is an Operational View of the present embodiment, showing the embodiment in operational mode with Adjustable Finger Connectors, Adjustable Thumb Connector and The Finger Connectors Suspension Connectors and the Thumb Connector Suspension Connector.

Referring to the Page 9—is an Operational View of the present embodiment, showing the embodiment in operational mode with Adjustable Finger Connectors (20) on one or more Flexible Suspension Connectors (66) in as seen in FIG. 12 showing another version of the completed view of the Apparatus Suspension System in its entirety with an apparatus (73) in place. It contains several Adjustable Finger Connectors (20) which could include one, two, three or four fingers—at The Index Finger Connector Suspension Connector (23), at the Middle Finger Connector Suspension Connector (69), at the Connector Finger Connector Suspension Connector (70) and the Pinky Finger Connector Suspension Connector (71) and the Adjustable Thumb Connector (40) at opposing ends of the Flexible Suspension Connector (66). All elements are connected together at the time of manufacturing. Connection points for the main elements are: First-End Suspension Connector (67) connects to The Index Finger Suspension Connector (23). And this is repeated for the other fingers. The Second-End of the Suspension Connector (68) connects to the Thumb Connector Suspension Connector (43). The Apparatus Suspension System may be made of a variety of materials. The preferred materials in this embodiment have been previously noted for each main element and sub-element. Other structural variations to the Apparatus Suspension Connector (66) may use other main elements or materials or other related sub-element materials or other connecting materials. In this embodiment, the apparatus bottom (73) is placed inside The Flexible Suspension Connector (66) first, and then the Flexible Suspension Connector (66) is slid up to the apparatus Top (62). There can also be many combinations of the Apparatus Suspension Connector (66) and the Flexible Suspension Connector (10) and the Glove (72) as well as all the other elements within these embodiments.

Alternative Embodiments of Embodiment

This embodiment or apparatus suspension system could be applied to any handheld tool or object to aid in gripping of the tool or object such as aiding a disabled person to eat with a spoon or fork, aiding a dentist or a surgeon in holding a drill or scalpel, aiding a construction worker in holding a hammer, aiding a hairdresser or used in any application whereby the user needs assistance in holding a handheld implement due to loss of strength, a handicap, or a disability.

Operation of Preferred Embodiment

The apparatus suspension system eliminates the need to tightly grasp, grip or clench any sports racquet (i.e. tennis racquet, squash racquet, racquetball racquet, badminton racquet, lacrosse stick, etc), by producing a racquet handle suspension in the hand eliminating the amount of grip pressure required from the hand, wrist and the arm and enables the user to release the device without fear of losing the device from their hand or losing control of the intended stroke.

The embodiment when applied to any sports racquet: a) decreases vibrational force at ball impact thereby reducing force upon the hand, wrist and arm, b) decreases racquet recoil effect at ball impact by shifting total mass and moment of inertia away from the hand, wrist and arm, c) allows for increased rotational torque of the racquet at ball impact without the need to grip the apparatus.

The apparatus suspension system is operated by placing one end of the embodiment around the index finger or other fingers of either hand and one end of the embodiment is placed around the thumb of the same hand. The Flexible Suspension Connector(s) which is part of the apparatus suspension system is now suspended over the palm of the hand between the index finger or other fingers and thumb. A sports racquet handle (but not limited to sports racquets) can be inserted in the palm of the hand held by the thumb and the index finger or fingers and behind the Flexible Suspension Connector(s) allowing the racquet handle to be held normally but now less tightly to conduct normal strokes or swings at an object such as a tennis ball. The sports racquet handle can be easily and instantaneously shifted around or even rocked behind the Flexible Suspension Connector to allow for backhand strokes, other types of grips or strokes as the user desires.

Specifically, the user dons, digit connectors, such as the first finger connector on a first finger of a user's hand and dons the thumb connector on a thumb of a user with the main suspension connector positioned on a palm-side of the user's hand. The digit connectors can be tightly secured to the user's digits. SPORTING equipment, such as a racquet, can be inserted in between the main suspension connector and a palm of the user. The user grips the sporting equipment in a proper position. The proper position is the position desired by the user for the intended type of swing. There are different proper positions known by the users for each type of swing. For example, in tennis, there is a proper position for a forehand swing, a different proper position for a backhand swing, a different proper position for a power serve, and a different, proper position for a spin serve. With the apparatus suspension system properly donned, the user can swing the sporting equipment at target equipment to create an impact between the sporting equipment and the target equipment. Target equipment is any equipment intended to be hit by the sporting equipment depending on the sport. For example, the target equipment in tennis would be the tennis ball; the target equipment in racquetball would be the racquet ball; the target equipment in baseball would be the baseball; the target equipment in hockey would be the puck; and so on. Approximately, upon impact between the sporting equipment and the ball, the user can release his/her grip on the sporting equipment. Surprisingly, the sporting equipment maintains the proper position it was placed in during impact even though the user is no longer gripping the sporting equipment. This allows the user to re-position the sporting equipment in the same proper position without making any adjustments to the sporting equipment, for example, during a follow-through of the swing. The proper position is maintained, in part, by the pair of suspension connector stabilizers connected to the main suspension connector.

Using the apparatus suspension system involves putting the Apparatus Suspension System on the hand that holds the racket or implement, assuring Apparatus Suspension System fits tightly, so as to not be too loose, taking practice swings without hitting a ball to familiarize to learn about how to swing without with out worry about the implement flying out of your hand and reduce awkwardness. Once the user is comfortable, the user can find a wall, and stand approximately 10 feet from the wall, begin by lightly hitting the ball against the wall using as slow a speed as possible, and using minimal racket or implement motion so as to familiarize himself/herself with this new dimension of hitting the ball with a mechanically hinged wrist motion instead of a full swing. The lack of a need to grip the implement eliminates the worry of the implement flying out of the user's hand. The user can continue with these motions until it becomes natural.

The player is now in a relaxed state, where the subconscious can be accessed and aid the game play. The next step of mental alignment is called the "square inch" process. This step allows the player to increase hitting the sweet spot on a consistent basis. The goal is to hit the center of the ball square-on because not doing so will adversely affect the trajectory of the ball. When the racket strikes the center of the ball the player has effectively hit the "square inch." To learn to hit the sweetspot, slowly and lightly hit the ball against the wall; visually follow the square inch of the ball as it comes off the wall and hits the ground. As it hits the ground, visually follow the square inch and say the word, "square" and as the ball rises, visually following the square inch to the racket, say the word, "inch." The reason this is done is that area of the ball that hits the racket is 1 square inch. Because players are relaxed and because they do not have to worry about gripping the racket, they are more easily able to direct their concentration to the "square inch" process where the subconscious aids the players by guiding the sweet spot on the racket to hit square inch of the ball.

This process can be continued, moving away from the wall in five feet increments until the user is approximately 39 feet from the wall. The user moves away only after having been able to continuously hit without missing the ball in both forehand and backhand strokes. When this is accomplished the player is in the "zone."

The previous steps employed the hinged-wrist process. The above steps can be repeated using a full swing for both forehand and backhand strokes. The goal is to familiarize your self with the action that is experienced by players in football or baseball whereas quarterbacks or pitchers actually release the ball from their grasp. Because of the embodiment the user can completely release the racket creating a new perspective on the mental strategy of the game.

Having accomplished the hinged-wrist stroke and the full swing separately, the user can now employ them both consistently. Users will know that they have reached this new mastered capacity when, on impact, they consistently will be in the zone which is described as "walking on air" which results from charka alignment.

Next is to employ this square inch process with the hinged wrist to the serve. The user stands on the baseline, tosses the ball into the air at least double arm's length above his/her head, watching the "square inch" of the ball and using a tapping approach with his/her hinged-wrist. He/she impacts the square inch of the ball as lightly as he/she can using just the wrist, with the racket arm and wrist remaining above his/her head. In doing this process, the user points his/her face and eyes skyward without being concerned with watching the ball after it impacts the racket. This is the main, fundamental aspects of a flat serve and in doing so the sweetspot of the racket can deliver maximum power to this stroke. This should be practiced until the user can achieve this on an automatic basis. The user's concentration should never follow the ball down range until this process is complete—i.e., don't look at where the ball is going until the stroke is completed. The hinged-wrist stroke must be completed before you move your head to look down the court to see where the ball went. This works on all serves, no matter what grip is deployed, i.e., a spin serve, a flat serve or any combination thereof.

As the user plays he/she will find that the apparatus suspension system allows for automatic micro-adjustments and absorbs the shock of the balls miss hit.

What has been described and illustrated herein is a preferred embodiment of the embodiment along with some of its variations. The terms, descriptions and figures used herein are set forth by way of illustration only and are not meant as limitations. Those skilled in the art will recognize that many variations are possible within the spirit and scope of the embodiment in which all terms are meant in their broadest, reasonable sense unless otherwise indicated. Any headings utilized within the description are for convenience only and have no legal or limiting effect.

What is claimed is:

1. An apparatus suspension system for a user's hand and a handled implement comprising:

a. four flexible suspension connectors made of a strong, flexible material so as to fit any implement handle;

b. four adjustable finger connectors and an adjustable thumb connector attached at opposite ends of the flexible suspension connector, each flexible suspension connector having a first end and a second end, wherein the first end of each flexible suspension connector is their respective finger connector, and the second ends of each flexible connector is connected to the adjustable thumb connector, wherein each flexible suspension connector is a ring, wherein the adjustable finger connector and the adjustable thumb connector comprise a small fastener to adjust the finger and thumb connectors, respectively, wherein the adjustable finger connector and the adjustable thumb connectors are each flattened, each having a front side and a back side, wherein each of the backsides of the adjustable finger connector and the adjustable thumb connector are covered with a supple material to provide comfort when encircled around a finger or a thumb, respectively;

c. wherein the apparatus suspension system is attachable to a hand and the handle implement is insertable between a palm of the hand and the flexible suspension connector and the adjustable finger connectors are associated with a glove.

2. The apparatus suspension system of claim 1, wherein the flexible suspension connector is a ring.

3. The apparatus suspension system of claim 1, wherein the flexible suspension connector further comprises a pair of suspension connector stabilizers.

4. A method of inducing enhanced ball speed, comprising the steps of:

a. providing an apparatus suspension system, the apparatus suspension system comprising i. a main suspension connector have a first end and a second end opposite the first end, ii. a first finger connector connected to the first end of the main suspension connector, and iii. a thumb connector connected to the second end of the main suspension connector;

b. donning the first finger connector on a first finger of a hand of a user and donning the thumb connector on a thumb of the hand of the user with the main suspension connector positioned on a palm-side of the user's hand;

c. inserting a sporting equipment in between the main suspension connector and a palm of the user;

d. gripping the sporting equipment in a proper position;

e. swinging the sporting equipment at a ball to create an impact between the sporting equipment and the ball.

5. The method of claim 4, wherein approximately upon impact between the sporting equipment and the ball, releasing a grip on the sporting equipment.

6. The method of claim 5, wherein after a follow-through of the swing, re-gripping the sporting equipment in the proper position without making any adjustments to the sporting equipment.

7. The method of claim 6, wherein a pair of suspension connector stabilizers connected to the main suspension connector maintains the sporting equipment in the proper position during the impact and the follow-through.

8. The method of claim 4, further comprising releasing a pressure on the sporting equipment by the palm of the user, and adjusting the sporting equipment to a second proper position.

9. An apparatus suspension system for a user's hand and a handled implement, comprising:

a. a plurality of main suspension connectors have a first end and a second end opposite the first end;

b. a plurality of finger connectors connected to the first end of the main suspension connector; and c. a thumb connector connected to the second end of the main suspension connector;

d. wherein each finger connector is connected to one main suspension connector, each of the plurality of main suspension connectors is connected to the thumb connector and the plurality of finger connectors are a part of a glove.

10. The apparatus suspension system of claim 9, further comprising a pair of suspension connector stabilizers on the main suspension connector in between the first end and the second end.

* * * * *